United States Patent [19]

Turi et al.

[11] Patent Number: 4,934,262

[45] Date of Patent: Jun. 19, 1990

[54] CONTAINER FOR STORING NEWSPAPERS AND AUTOMATICALLY DISPERSING TWINE FOR BUNDLING NEWSPAPERS

[75] Inventors: Lou Turi; Richard Turi, both of Toms River, N.J.

[73] Assignee: Innovative Products, Inc., Brick Town, N.J.

[21] Appl. No.: 346,893

[22] Filed: Jul. 21, 1989

[51] Int. Cl.[5] ..... B65B 13/18

[52] U.S. Cl. ..... 100/34; 100/99; 100/248; 100/265; 211/50

[58] Field of Search ..... 100/1, 34, 17, 99, 265, 100/248, 249, 4; 211/50, 51

[56] References Cited

U.S. PATENT DOCUMENTS

| | | | |
|---|---|---|---|
| 636,160 | 10/1899 | Mitchell | 100/99 |
| 1,246,923 | 11/1917 | Horrigan | 100/34 X |
| 1,816,252 | 7/1931 | Fouse | 100/99 |
| 2,636,432 | 4/1953 | Sherer | 100/34 |
| 3,145,646 | 8/1964 | Levy | 100/34 |
| 3,498,214 | 3/1970 | Bailey | 100/34 |
| 4,154,159 | 5/1979 | Ortega | 100/99 X |

*Primary Examiner*—Harvey C. Hornsby
*Assistant Examiner*—Stephen F. Gerrity
*Attorney, Agent, or Firm*—Clifford G. Frayne

[57] ABSTRACT

A container for accumulating newspapers for disposal, the container dimensions approximating the dimensions of a standard newspaper, the container having spools of cord or twine disposed within the container, the cord or twine positioned within a guide path across the support tray for the accumulated newspapers such that the weight of the accumulated newspapers causes the support tray to descend within the container automatically dispersing additional cord or twine such that when sufficient newspapers have been accumulated, the cord or twine from the spools is already dispersed in sufficient quantity to permit the operator to bundle the newspapers about their lateral circumference and longitudinal circumference and remove them from the container for disposal.

5 Claims, 4 Drawing Sheets

FIG. 1
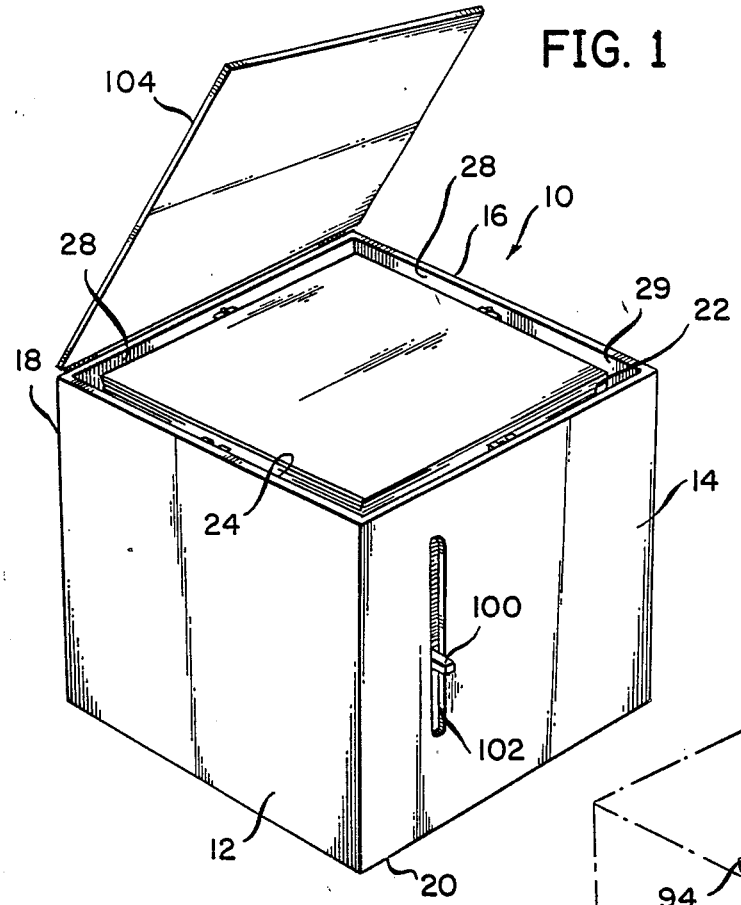
FIG. 5
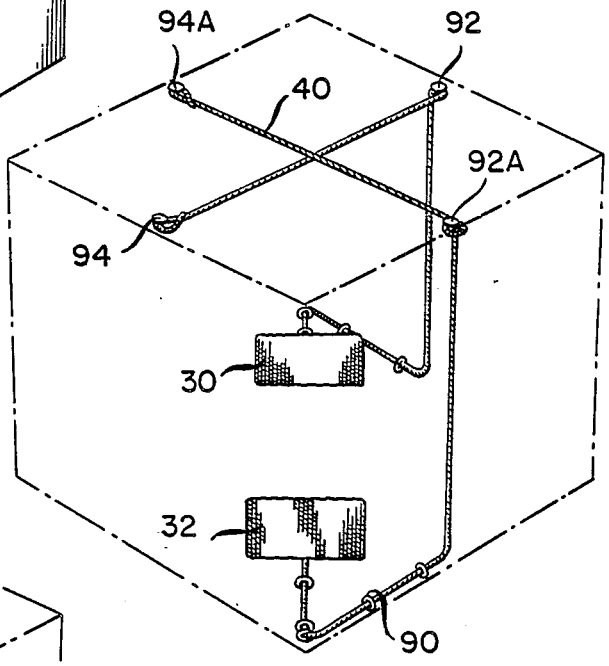
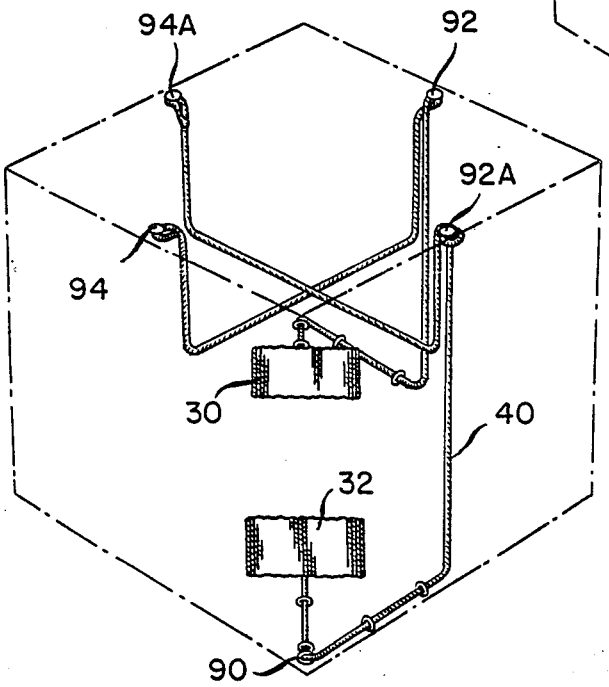
FIG. 6

CONTAINER FOR STORING NEWSPAPERS AND AUTOMATICALLY DISPERSING TWINE FOR BUNDLING NEWSPAPERS

FIELD OF INVENTION

The present invention relates to an apparatus for storing accumulated newspapers in an aesthetic fashion and automatically dispersing a securing means in the form of string, twine or cord to secure the accumulated newspapers in a bundle within the storage container once it has become full.

BACKGROUND OF THE INVENTION

The accumulation of newspapers in the home or in the office occurs at an ever-increasing pace as a result of the increased volume of the newspapers. Additionally, environmental laws now mandate recycling for newspapers and in many instances, in many communities, newspapers are only collected on certain days of the month or alternatively, must be delivered by the user to a preordained disposal location. In most all instances, the requirement is that the newspapers be bundled with cord, not be encased in a plastic disposal bag and be bundled in a certain size or configuration.

In most instances, it will take several days to accumulate the newspapers to the volume acceptable by the recycling agency. Then, the homeowner or office worker must stack the newspapers and tie them in bundles for disposal. This procedure is often time-consuming, awkward and results in newsprint ink being deposited on the individual attempting to bundle the newspapers. Additionally, the storage of the newspapers presents a problem while waiting to accumulate the necessary number in order to effectuate the proper size of the bundle. This accumulation often results in an eyesore in the room or office or the additional step of storing the newspapers in a closet or garage until the necessary volume has been accumulated.

The Applicant's invention relates to an aesthetic container which could even be suitable for room display, but could be stored in a closet or garage and which permits the papers to be accumulated until the correct volume has been acquired, the papers being stored in the container awaiting the predetermined volume, and the container automatically dispersing the substantial quantity of twine or cord required to secure the predetermined amount of newspapers, the twine or cord fashioned within the container on a series of guidepins to allow the operator to secure the bundle of papers with a minimum of inconvenience.

OBJECTS OF THE INVENTION

It is a primary object of the present invention to provide for a novel container for the accumulation of newspapers having an automatic dispersal means positioned within the container for the dispersal of securing twine in order to secure the bundle of newspapers.

It is still another object of the present invention to provide for a novel container for the accumulation of newspapers in which the securing mechanism automatically disperses the cord or twine to accommodate the accumulated newspapers.

It is still a further object of the present invention to provide a container having a series of guide tracks such that the cord or twine automatically dispersed is automatically positioned for securing the accumulated newspapers.

It is a still further object of the present invention to provide for a novel container for the accumulation and securing of newspapers which provides for a visual indication regarding the amount of newspapers accumulated.

It is a still further object of the present invention to provide for a novel container for the accumulation of newspapers in which a newspaper support tray is biasly mounted order to automatically disperse cord or twine and automatically adjust the visual indicator.

SUMMARY OF THE INVENTION

A container for the accumulation of newspapers comprised of four sidewalls defining a chamber, the chamber being substantially the dimensions of a daily newspaper, the chamber having a biasly mounted support tray positioned therein, the chamber having mounted in its lower portion, beneath the support tray, spools of twine, the twine positioned as a result of guide means, on the support tray, and secured to opposing sidewalls of the container, the biasly mounted support tray depressed downwardly as a result of the accumulation of the weight of newspapers thereon, the downward displacement of the support tray automatically dispersing cord or twine from the spools such that when the support tray reaches its lowermost position as indicated by a visual indicator, substantially sufficient cord or twine will have been dispersed from the spools in order to secure the accumulated papers in a bundle for disposal.

BRIEF DESCRIPTION OF THE DRAWINGS

The objects of the present invention as well as other novel features thereof will become more apparent by reference to the following description, particularly when taken in conjunction with the accompanying figures in which:

FIG. 1 is a perspective view of the container;

FIG. 5 is a schematic view of the cord or twine path with no newspapers present in the container;

FIG. 6 is a schematic view of the cord or twine path with accumulated papers in the container.

DETAILED DESCRIPTION OF THE DRAWINGS

Figure 2:
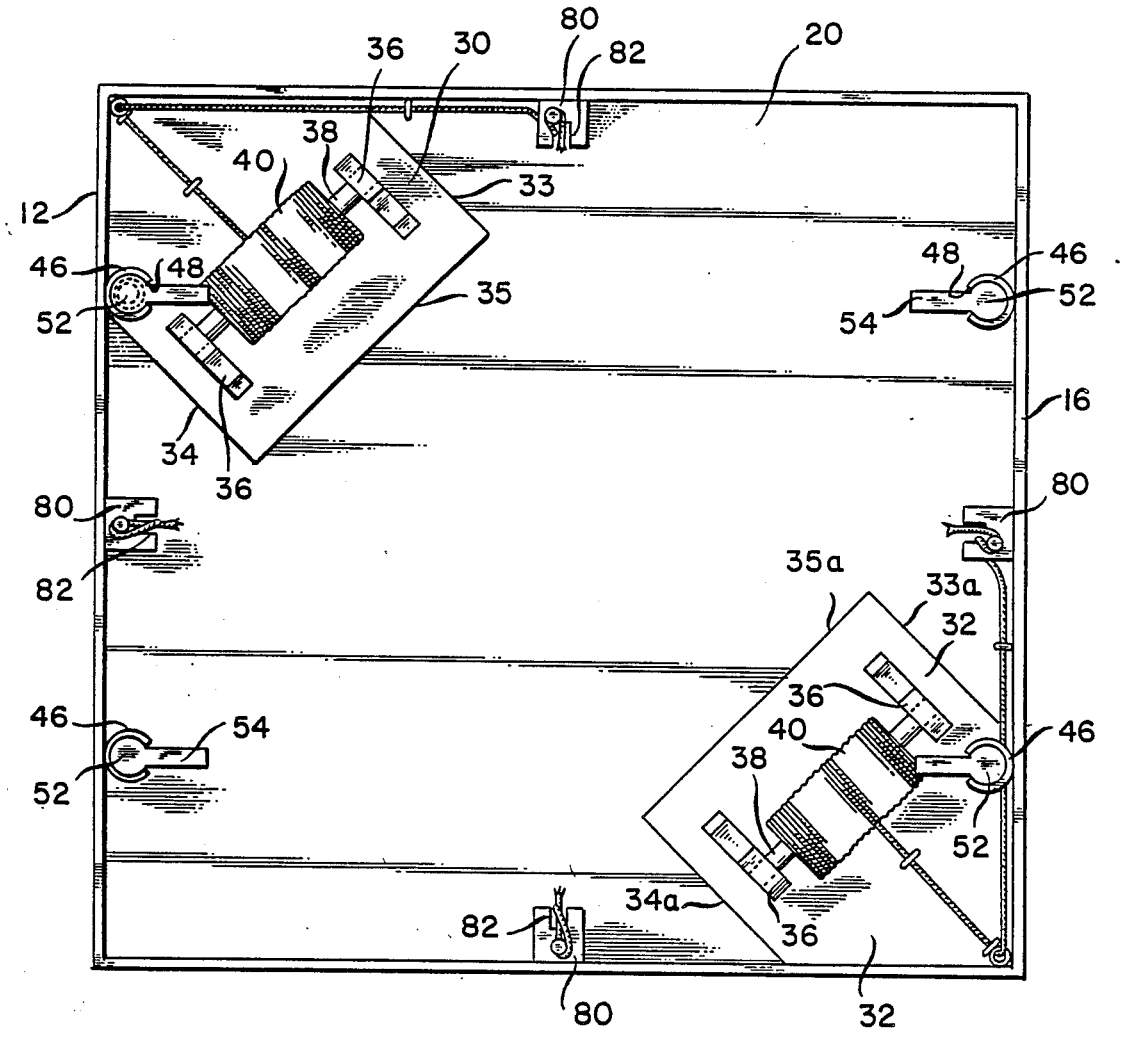
FIG. 2 is a top planer view of the container with support tray removed.

Referring to FIGS. 1 and 2, there is shown a perspective and a top planer view of newspaper collection chamber 10. Newspaper collection chamber 10 is comprised of four sidewalls, 12, 14, 16 and 18, respectively. Sidewalls are secured to a bottom wall 20, such that inner walls 22, 24, 26 and 28 of sidewalls 12, 14, 16 and 18, define a chamber 29 approximating the configuration and dimensions of a daily newspaper.

Disposed within container 10, are two spool chambers 30 and 32, respectively. In this embodiment, spool chambers 30 and 32 are shown positioned in diagonally opposed corners within container 10. Spool chambers 30 and 32 comprise sidewalls 33, 34, 35 on spool chamber 30 and sidewalls 33(*a*), 34(*a*) and 35(*a*) on spool chamber 32. These sidewalls are in contact with bottom wall 20 and the respective inner walls of sidewalls 22, 24, 26 and 28. The sidewalls of spool chambers 30 and 32, respectively, support a pair of spool holders 36, spool holders 36 in pairs, designed to accommodate a spool 38 about which there is wound, cord or twine 40. Spool holders 36 are positioned to maintain spool 3B in position yet allow spool 38 to rotate freely within spool holders 36 in order that the cord or twine 40 may be freely dispersed from spool 38 as disclosed hereafter. Additionally, the sidewalls of spool chambers 30 and 32, respectively, are of such a height from bottom wall 20 so as to limit the downward movement of a support tray described hereafter and the newspapers accumulated thereon.

Referring further to FIG. 2, opposing sidewalls of container 10 have positioned thereon opposing pairs of support tracks 46. In this embodiment, one pair of support tracks 46 are positioned in sidewall 12 and the other pair of support tracks 46 are positioned in sidewall 16. In this configuration, support tracks 46 are vertically depending tubes on sidewalls 12 and 16 having a longitudinal, vertical slit 48 communicating with the inner chamber 29 defined by the sidewalls. Vertical, longitudinal tubes which comprise support tracks 46 are open at their upper end and terminate proximate to bottom wall 20. Positioned within support track 46 is a biasing means comprised of a spring 50 and a support pin 52 having a cross sectional area which permits it to slide within support track 46, support pin 52 having an extending arm 54 which extends through longitudinal opening 48, arm 54 providing support for the support tray for the newspapers as described hereafter. With biasing spring 50 inserted into support track 46 and tray pin 52 inserted on top of biasing spring 50, support arm 54, extending through longitudinal slit 48 should be positioned below but proximate to the top of sidewalls 12, 14, 16 and 18 in order to accommodate the support tray disclosed hereafter, and the initial newspapers inserted into container 10.

Figure 3:
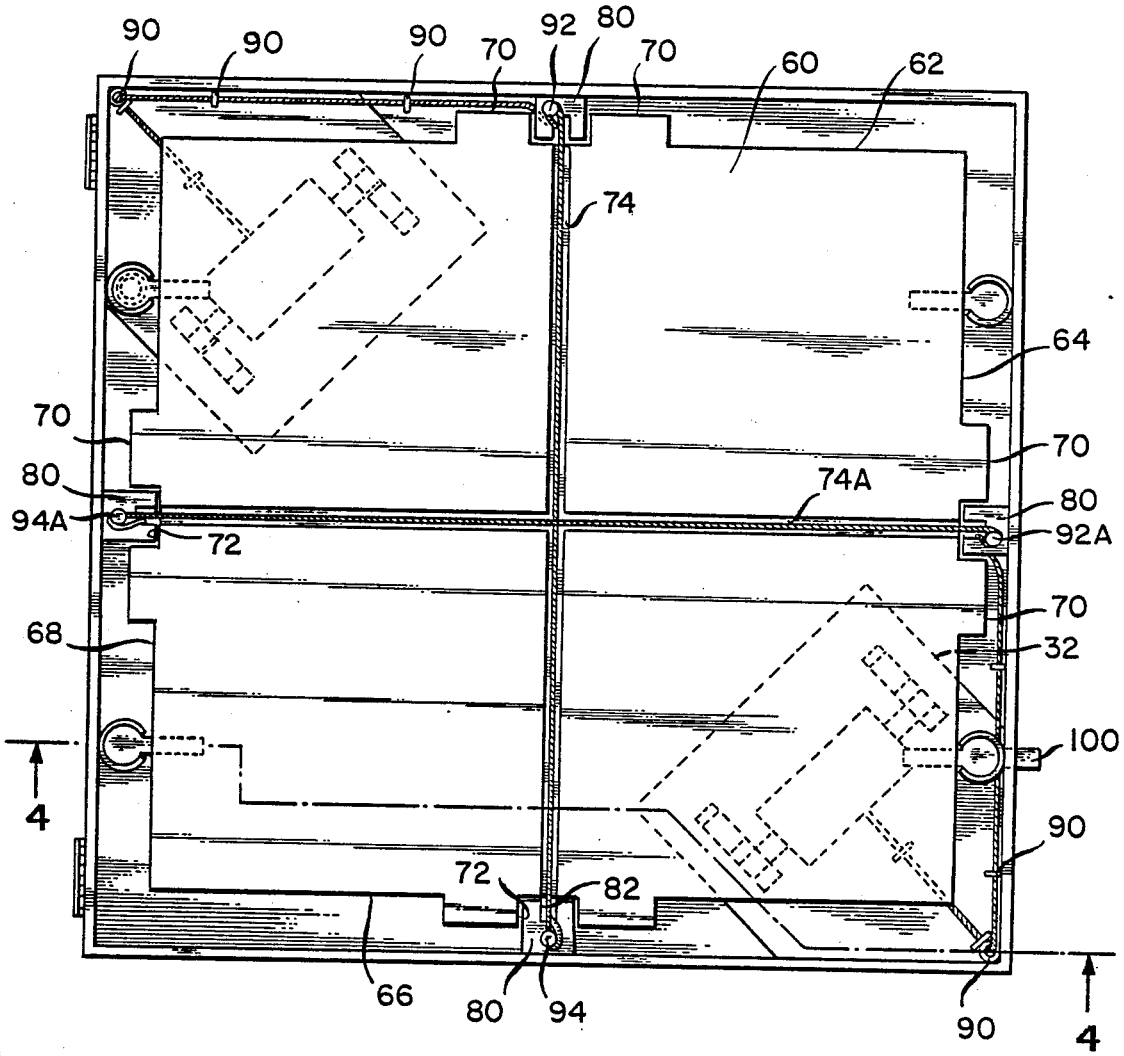
FIG. 3 is a top planer view of the container with the support tray.

Referring to FIG. 3, there is shown a top planer view of container 10 with support tray 60. Support tray 60 is planar in structure defined by edges 62, 64, 66 and 68. Centrally positioned on each of the aforementioned edges and protruding outwardly therefrom, are a pair of guide ribs 70, defining a guide channel 72 therebetween. Perpendicularly positioned between opposing guide channels 72 are twine grooves 74 and 74A providing for a channeled depression in the face of support plate 60. Twine groove 74 and 74A intersect at the center of support plate 60.

Referring back to FIG. 2, there is shown a vertically positioned track guide 80 centrally positioned on each sidewall of container 10, and longitudinally, vertically disposed thereon. Track guide 80 is generally U-shaped in cross sectional configuration defining a vertically, longitudinally disposed channel 82. Track guide 80 is dimensioned such that it slides within channel guide 72 on support plate 60.

In this configuration, once biased spring 50 and tray support pin 52 are positioned in each support track 46, support tray 60 is positioned within container 10 and supported by support arms 54 with guide channel 72 cooperating with guide track 80 on each of the respective inner walls of container 10.

Figure 4:
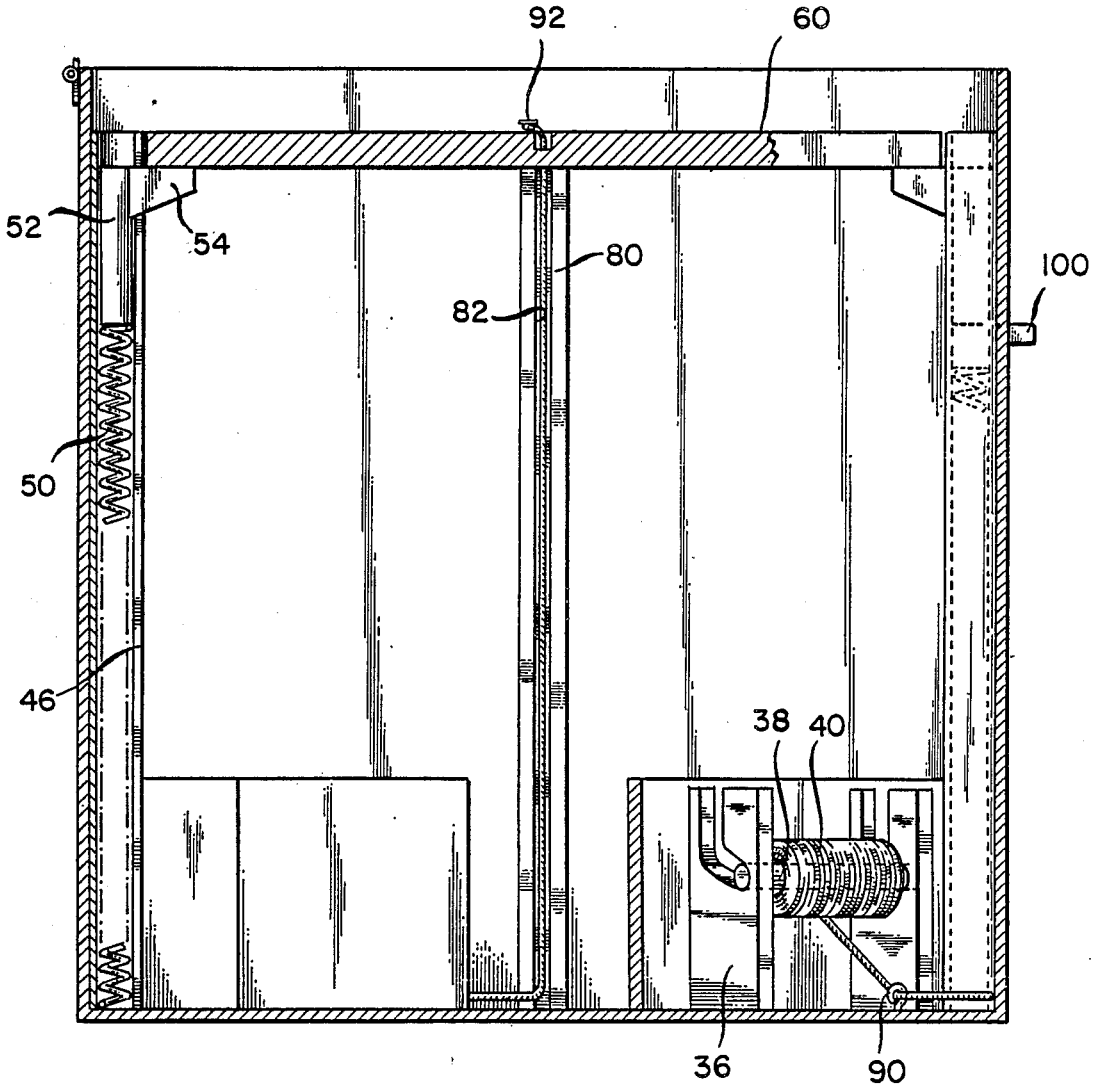
FIG. 4 is a side sectional elevational view of the container along plan 4—4 of FIG. 3.

FIG. 4 is a side sectional elevational view of container 10 and FIG. 5 is a schematic of the cord or twine path with no newspapers present and FIG. 6 is a schematic of the cord or twine path with newspapers present. These views will aid with respect to the description of the dispersal of cord or twine 40 and the path it follows.

The twine or cord 40 on spool 38 in respect to spool chambers 30 and 32 is fed from spool 38 through a series of guide loops 90, to a guide post 92, mounted at the top of guide track 80. Guide post 92 is off center on die track 80 to permit the string or cord to then be fed across support tray 60 in channel 74, to a hook pin 94 positioned on the opposite guide track over which the twine or cord is looped and secured. The path of the cord or twine 40 from the opposite spool 38 follows an identical path which is perpendicular to the first path across support tray 60. Being guided by an identical guide post 92 and hook pin 94A. In this configuration, the string is now in position on the support tray for the receipt of newspapers. As the newspapers are placed on the tray, the biasing spring means 50 is depressed causing the tray to descend. Since the twine or cord is secured to hook pins 94 and 94A respectively, additional twine 40 is played out from spools 38 through guide hooks 90 to guide post 80 and 80A, respectively. Since the support tray 60 is descending, the twine or cord 40 now proceeds downwardly through U-shaped longitudinal passageway 82 in guide track 80 under the newspapers and thence across support tray 60 by means of channel 74. The playout of cord or twine 40 from spool 38 would continue until support tray 60 had reached its bottom-most position wherein support pins 52 and support arms 54 would contact spool chambers 30 and 32 thus stopping the descent. At this point, the operator has cord or twine secured at hook pins 94 and 94A, respectively and has access to the cord or twine 40 at guide post 80 and 80A, respectively. The operator would then remove the cord or twine 40 from hook pin 94 and draw it across the top of the bundle of newspapers thereby unraveling more cord 40 from spool 38 until he was proximate to the guide post 80. The operator would then pull additional string from guide post 80, cut the string and tie the bundle. The same process would be repeated between guide post 80A and hook pin 94A. The bundle of papers can then be removed from container 10 for disposal. The operator would then reset the cord about guide post 80 and hook pin 94 and guide post 80A and hook pin 94A. The container would then be in condition for the receipt of additional papers.

An additional feature which can be incorporated in the apparatus is a indicator means which would comprise an arm 100 incorporated on one of the support pins 52, arm 100 extending outwardly through one of the sidewalls and riding in a vertical, longitudinal aperture 102 in the side wall, arm 100 serving as a visual indicator as to the amount of newspapers accumulated. Additionally, as shown in FIG. 1, chamber 10 can be fitted with a lid 104 which can be secured to the top of one sidewall in any one of a number of convenient manners.

While the present invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and equivalents thereof.

I claim:

1. An apparatus for accumulating newspapers and bundling newspapers comprising:

a container, defined by four sidewalls, and a bottom wall defining a chamber, the cross sectional area of said chamber as defined by said sidewalls proximating the dimensions of a newspaper, said container having a removable, securable top;

biasly mounted support arms disposed on said sidewalls of said container, said support arms extending inwardly into said chamber, said support arms positioned within a vertical support track means;

guide tracks, vertically positioned on the interior of each said sidewall, said guide tracks having a vertically-disposed groove in each of said guide tracks;

a support tray positioned within said container, said support tray positioned on said support arms, said support tray having guide fingers complimentary to said vertically disposed guide tracks on said sidewalls, said support tray having a longitudinal and lateral groove on its upper planar surface, said longitudinal and lateral grooves in alignment with said vertical groove in said vertically disposed guide tracks on said inner walls of said sidewalls;

a securing means positioned in said container proximate to said bottom wall, said securing means disposed within said container by a series of guide means defining a path for dispersing and positioning said securing means about said accumulated newspapers.

2. An apparatus in accordance with claim 1 wherein said securing means positioned in said container proximate to said bottom wall comprises two spools of cord positioned on mounting brackets, said spools of cord freely rotatable about the axis of said spool, said cord positioned by said guide means on said path positioning said cord from the said respective spools about said longitudinal circumference of said accumulated newspapers and said lateral circumference of said accumulated newspapers, respectively.

3. An apparatus in accordance with claim 1 wherein said searing means comprises two spools of cord and said path for said securing means comprises a series of guide rings directing said securing means from each of said spools to a respective guide post positioned on top of said guide tracks, said securing means extending to a guide hook on said opposite guide track and affixed thereto, said positioning of said respective securing means from said respective spools positioning said securing means in said longitudinal and lateral groove on said upper planar surface of said support tray.

4. An apparatus in accordance with claim 1 wherein said support tray mounted on said biasly mounted support arms, descends and responds to downward pressure of said accumulated newspaper, the said descent of said support tray dispersing said securing means in response to said accumulation of newspapers, said guide post and said guide hook in said path of said securing means positioning said securing means in said vertically-disposed groove in said guide tracks as said support tray descends.

5. An apparatus in accordance with claim 1 wherein at least one of said biasly mounted support arms contains a visual indicator extending outwardly from said container, said visual indicator identifying the weight of said accumulated newspapers.

* * * * *